US007140282B1

(12) United States Patent
Chang

(10) Patent No.: US 7,140,282 B1
(45) Date of Patent: Nov. 28, 2006

(54) PNEUMATIC WRENCH HAVING REINFORCED STRENGTH

(76) Inventor: Hsin Ho Chang, No.283, Guangfu Rd., Situn District, Taichung City (TW) 407

( * ) Notice: Subject to any disclaimer, the term of this patent is extended or adjusted under 35 U.S.C. 154(b) by 0 days.

(21) Appl. No.: 11/141,601

(22) Filed: May 31, 2005

(51) Int. Cl.
*B25B 19/00* (2006.01)
*B25D 15/00* (2006.01)

(52) U.S. Cl. ..... 81/466; 81/463; 81/464; 81/465

(58) Field of Classification Search ..... 81/466, 81/54, 464, 465, 463; 173/93, 93.5, 109
See application file for complete search history.

(56) References Cited

U.S. PATENT DOCUMENTS 2,463,656 A * 3/1949 Thomas ..... 173/93.5
3,533,479 A * 10/1970 Albertson et al. ..... 173/93.5
6,119,794 A * 9/2000 Chen ..... 173/93
6,648,080 B1 * 11/2003 Liao ..... 173/93.5

* cited by examiner

*Primary Examiner*—David B. Thomas
*Assistant Examiner*—Robert Scruggs
(74) *Attorney, Agent, or Firm*—Bacon & Thomas

(57) ABSTRACT

A pneumatic wrench includes a pneumatic motor, a striking mechanism, and a drive shaft. The striking mechanism includes a cylindrical support seat, a cam, a cover, and a hammer. The hammer has a protruding engaging portion and a reinforcing rib juxtaposed to the engaging portion to reinforce the structural strength of the hammer. Thus, the two opposite sides of the hammer are connected by the reinforcing rib to reinforce the structural strength of the hammer, thereby preventing the hammer from being distorted or broken due to concentration of a stress so as to enhance the lifetime of the hammer.

10 Claims, 7 Drawing Sheets

PNEUMATIC WRENCH HAVING REINFORCED STRENGTH

BACKGROUND OF THE INVENTION

1. Field of the Invention

The present invention relates to a pneumatic wrench, and more particularly to a pneumatic wrench having a reinforced structural strength to withstand a larger torque.

2. Description of the Related Art

A conventional pneumatic wrench in accordance with the prior art shown in FIGS. 7–11 comprises a pneumatic motor (not shown), a striking mechanism 10, and a drive shaft 20. The drive shaft 20 is mounted on a socket (not shown), the striking mechanism 10 is mounted on the drive shaft 20, and the pneumatic motor is mounted on the striking mechanism 10 so that the striking mechanism 10 is mounted between the pneumatic motor and the drive shaft 20. Thus, the striking mechanism 10 is driven by the pneumatic motor to rotate in the normal direction and the reverse direction to drive the drive shaft 20 to rotate, so that the drive shaft 20 is driven to rotate the socket mounted on the drive shaft 20 so as to drive and rotate a screw member, such as a bolt, nut or the like.

The striking mechanism 10 includes a cylindrical support seat 11 having a closed first end face and an open second end face, a cam 13 rotatably mounted on the first end face of the support seat 11 and engaged with and rotated by the pneumatic motor, a cover 12 mounted on the second end face of the support seat 11, and a hammer 16 rotatably mounted in the support seat 11 and engaged with the cam 13 so that the hammer 16 is driven by the cam 13 to rotate in the support seat 11. The cam 13 has a periphery formed with an engaging recess 14. The hammer 16 has a first end formed with a protruding engaging portion 17 engaged in and driven by the engaging recess 14 of the cam 13 so that the hammer 16 is driven by the cam 13 to rotate in the support seat 11. The first end of the hammer 16 is formed with a first pivot shaft 18 pivotally mounted in the first end face of the support seat 11. The hammer 16 has a second end formed with a second pivot shaft 180 pivotally mounted in the second end face of the support seat 11. The second end face of the support seat 11 has a periphery formed with a pivot hole 110 for mounting the second pivot shaft 180 of the hammer 16. The drive shaft 20 has a first end formed with an engaging portion 25 engaged with the hammer 16 and a second end formed with a mounting section 22 for mounting the socket. The engaging portion 25 of the drive shaft 20 is formed with a driven groove 26 engaged with and driven by the hammer 16 so as to produce a striking effect on the drive shaft 20 by rotation of the hammer 16.

In operation, after the compressed air enters the pneumatic motor, the pneumatic motor is operated to rotate the cam 13 which engages the hammer 16 so that the hammer 16 is driven by the cam 13 to pivot in the support seat 11. Thus, the hammer 16 is pivoted to strike the drive shaft 20, and the hammer 16 strikes the drive shaft 20 once when the hammer 16 is rotated through a circle, so that the drive shaft 20 is driven to rotate the socket mounted on the mounting portion 22 of the drive shaft 20 so as to drive and rotate a screw member, such as a bolt, nut or the like.

However, the hammer 16 is substantially arc-shaped so that most of the stress of the hammer 16 is concentrated on the two opposite sides 160 of the hammer 16 during operation of the hammer 16, so that the hammer 16 is easily distorted or broken during a long-term utilization, thereby decreasing the lifetime of the hammer 16.

SUMMARY OF THE INVENTION

The primary objective of the present invention is to provide a pneumatic wrench having a reinforced structural strength to withstand a larger torque.

Another objective of the present invention is to provide a pneumatic wrench, wherein the two opposite sides of the hammer are connected by the reinforcing rib to reinforce the structural strength of the hammer, thereby preventing the hammer from being distorted or broken due to concentration of a stress so as to enhance the lifetime of the hammer.

A further objective of the present invention is to provide a pneumatic wrench, wherein the cover has a periphery formed with a protruding rib encompassing the pivot hole of the support seat to withstand the stress of the pivot hole of the support seat so as to enhance the structural strength of the support seat.

In accordance with the present invention, there is provided a pneumatic wrench, comprising:

a striking mechanism including a cylindrical support seat having a closed first end face and an open second end face, a cam rotatably mounted on the first end face of the support seat, a cover mounted on the second end face of the support seat, and a hammer rotatably mounted in the support seat and engaged with the cam so that the hammer is driven by the cam to rotate in the support seat, wherein the hammer has a first end formed with a protruding engaging portion and a reinforcing rib juxtaposed to the engaging portion to reinforce a structural strength of the hammer.

Further benefits and advantages of the present invention will become apparent after a careful reading of the detailed description with appropriate reference to the accompanying drawings.

DETAILED DESCRIPTION OF THE INVENTION

Figure 1:
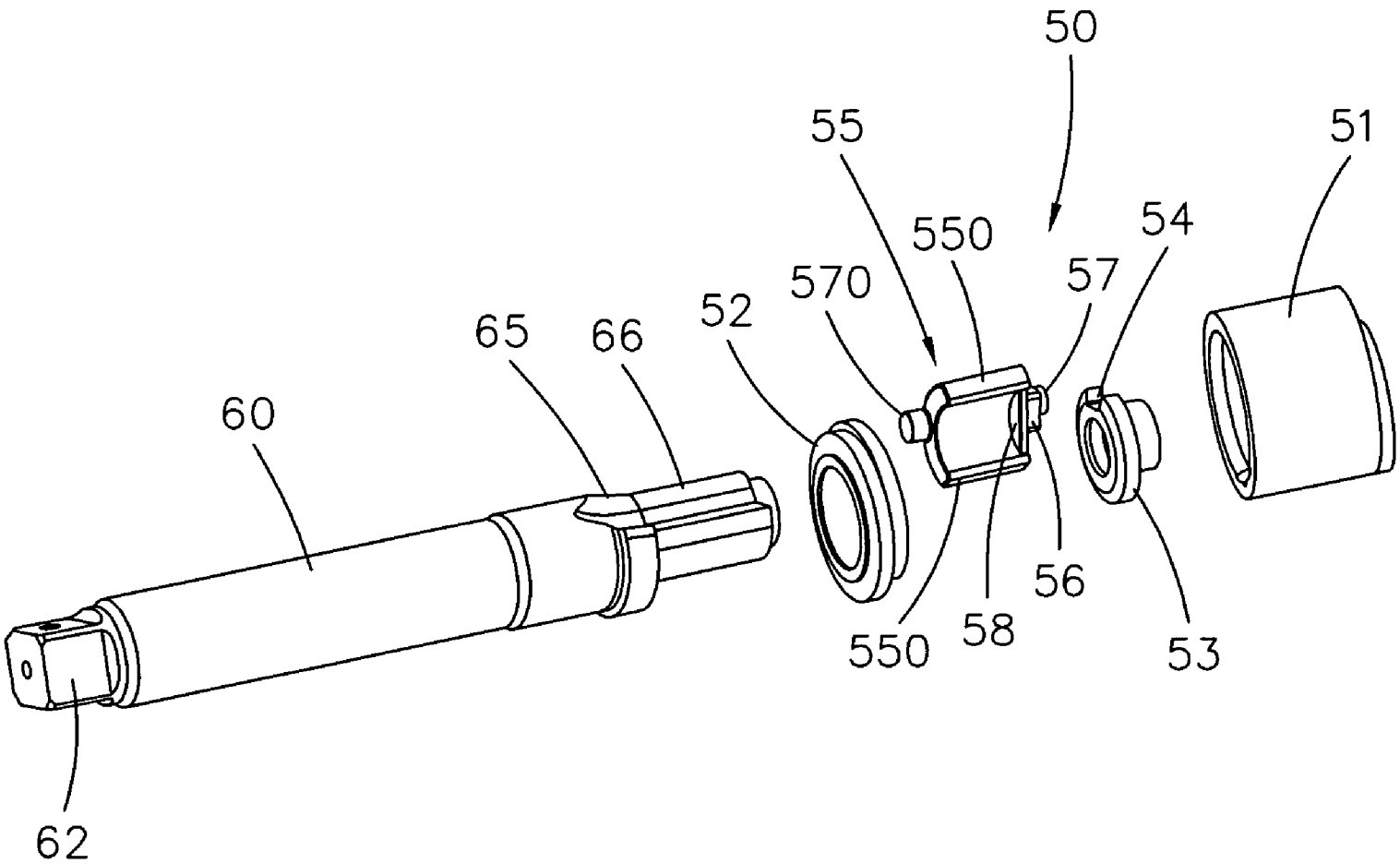
FIG. 1 is an exploded perspective view of a pneumatic wrench in accordance with the preferred embodiment of the present invention.
Figure 2:
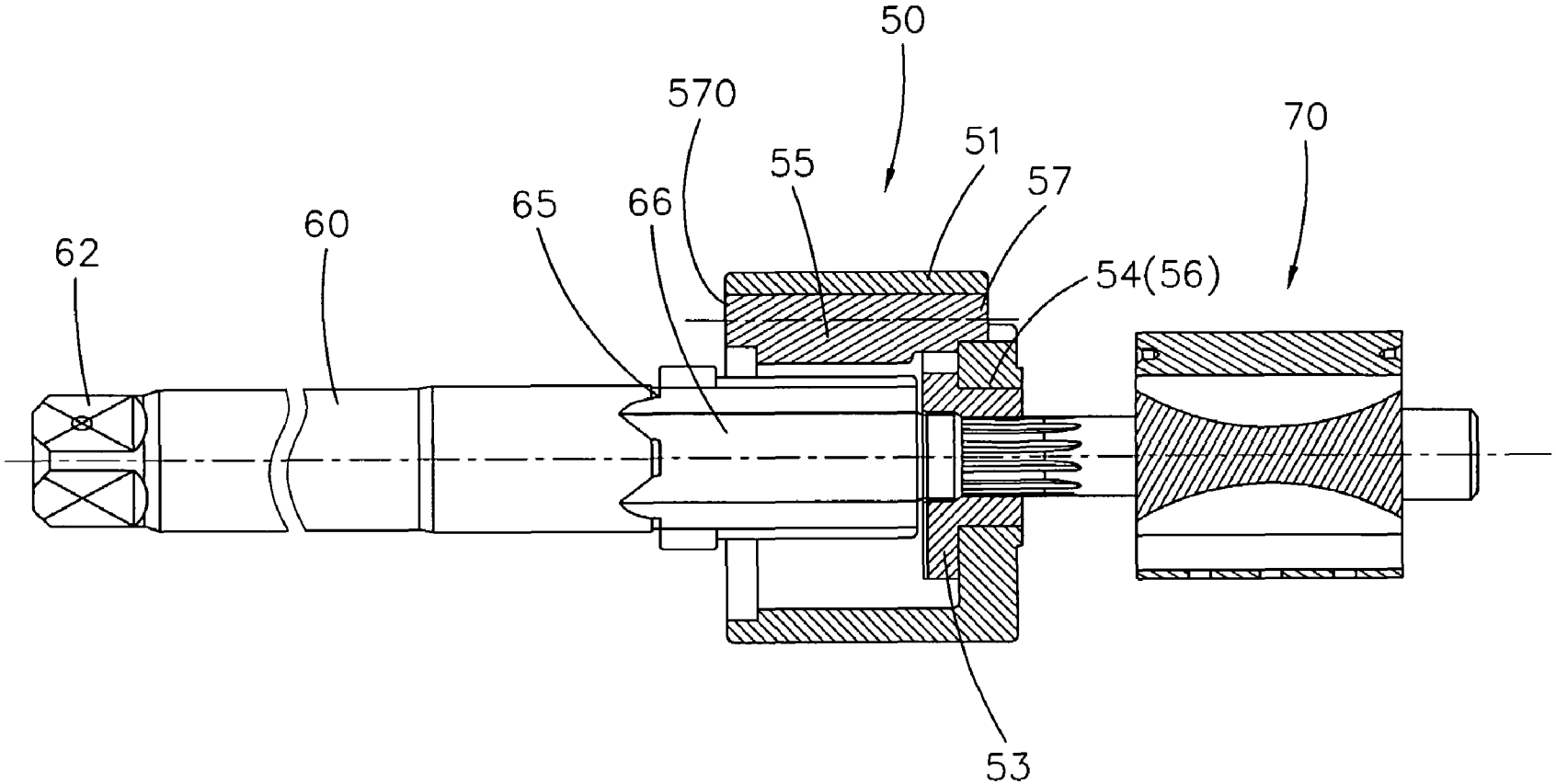
FIG. 2 is a plan cross-sectional assembly view of the pneumatic wrench as shown in FIG. 1.
Figures 3, 4:
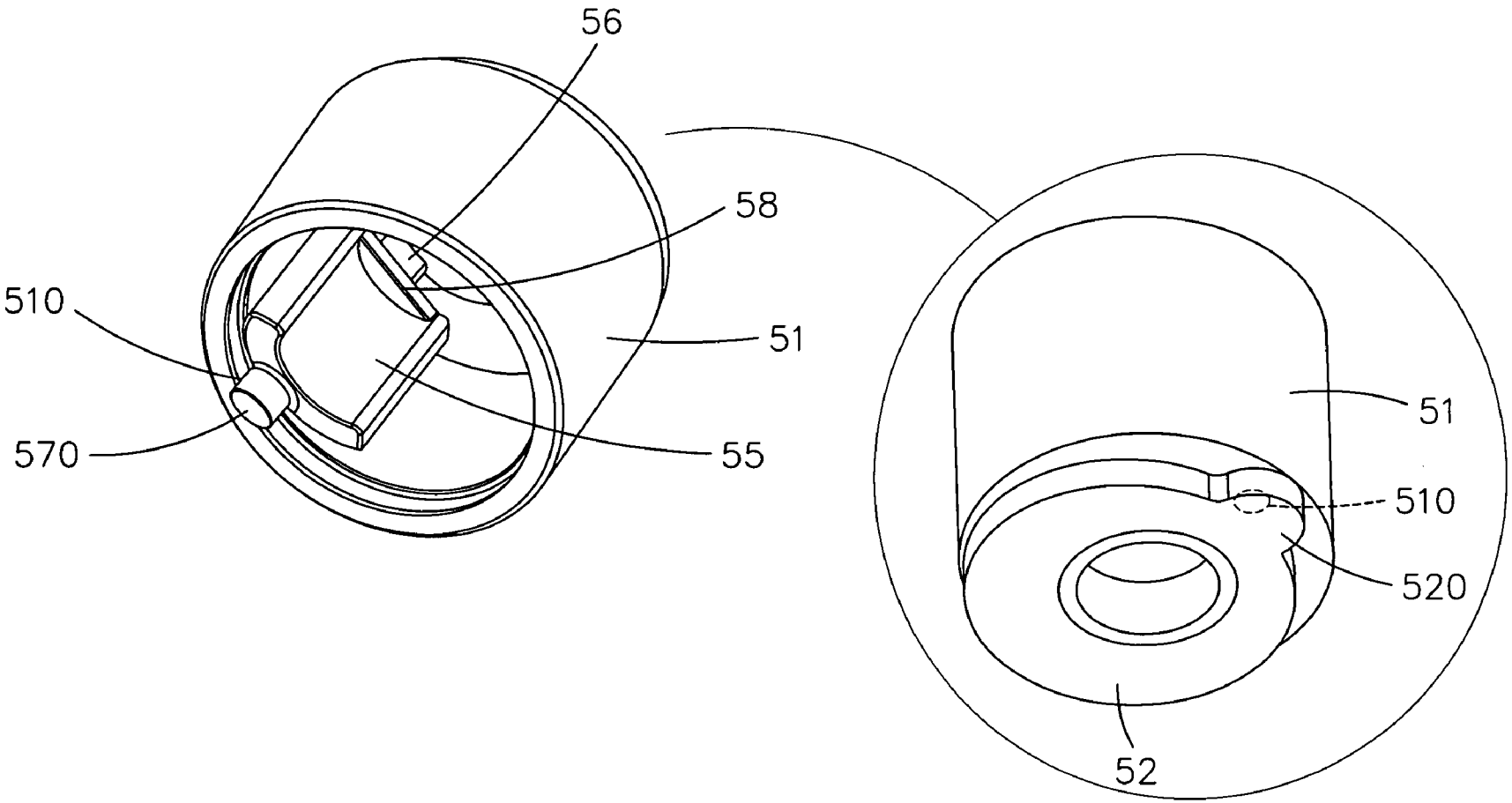
FIG. 3 is a locally enlarged perspective assembly view of the pneumatic wrench as shown in FIG. 1.
FIG. 4 is a locally enlarged perspective assembly view of the pneumatic wrench as shown in FIG. 1.
Figure 6:
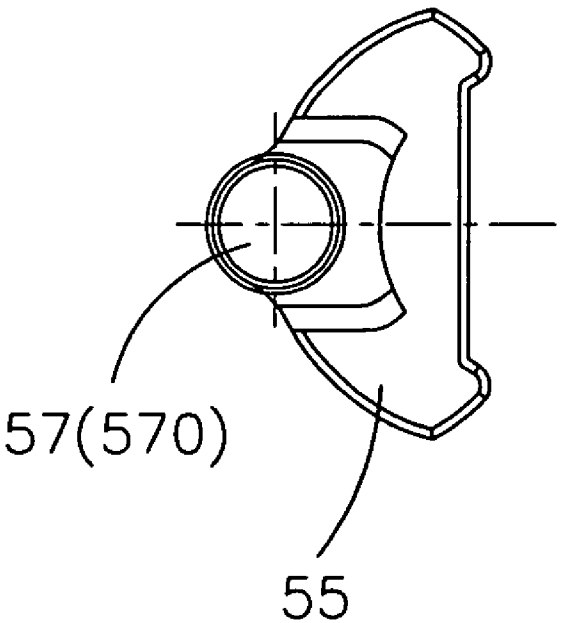
FIG. 6 is a plan view of the hammer of the pneumatic wrench as shown in FIG. 5.
Figure 5:
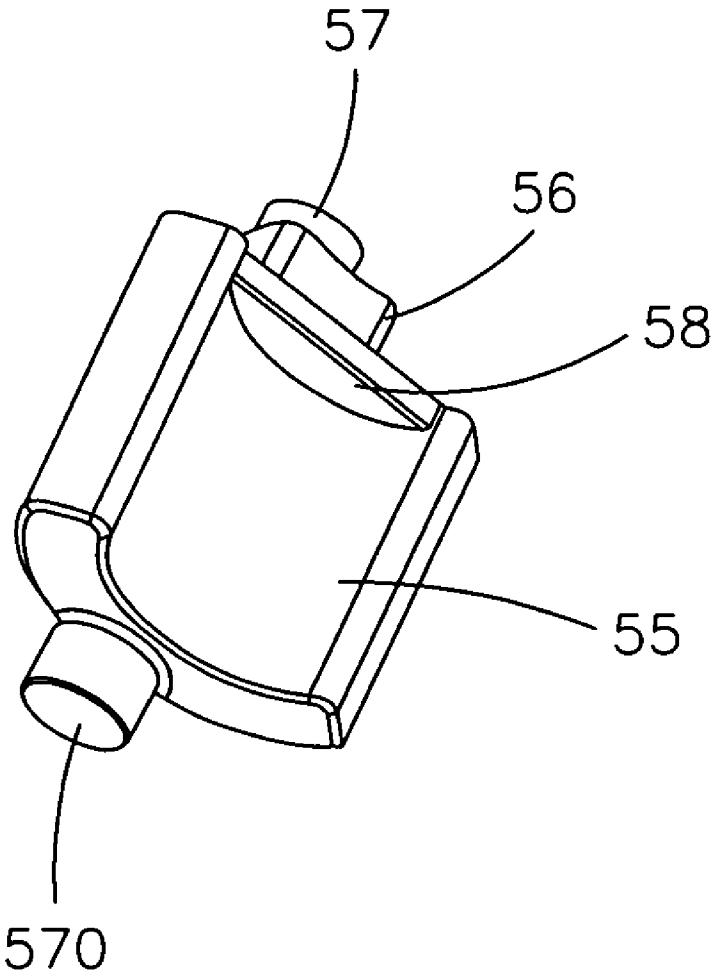
FIG. 5 is a locally enlarged perspective view of a hammer of the pneumatic wrench as shown in FIG. 3.
Figure 7:
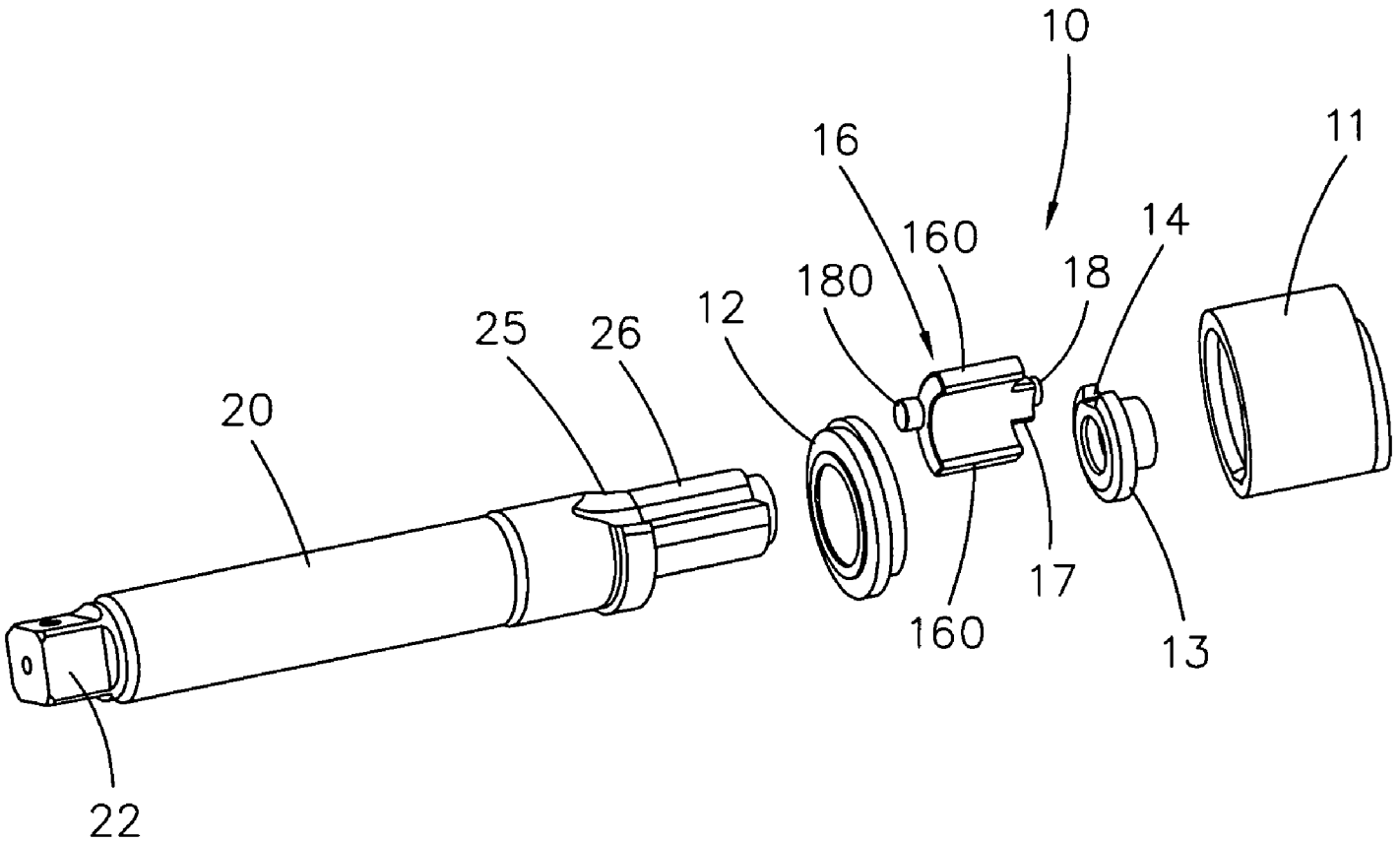
FIG. 7 PRIOR ART
FIG. 7 is an exploded perspective view of a conventional pneumatic wrench in accordance with the prior art.
Figure 9:
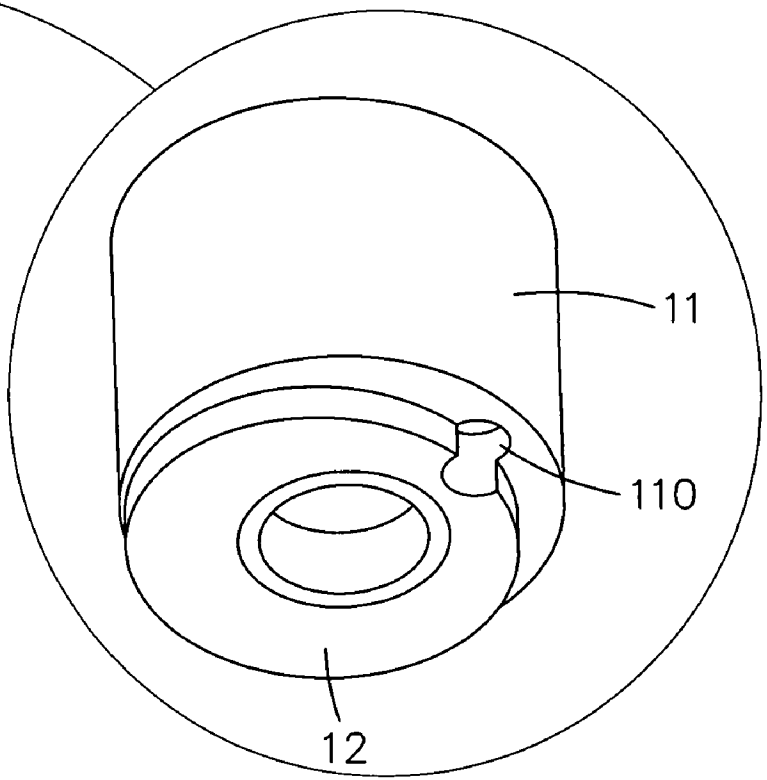
FIG.9 PRIOR ART
FIG. 9 is a locally enlarged perspective assembly view of the conventional pneumatic wrench as shown in FIG. 7.
Figure 8:
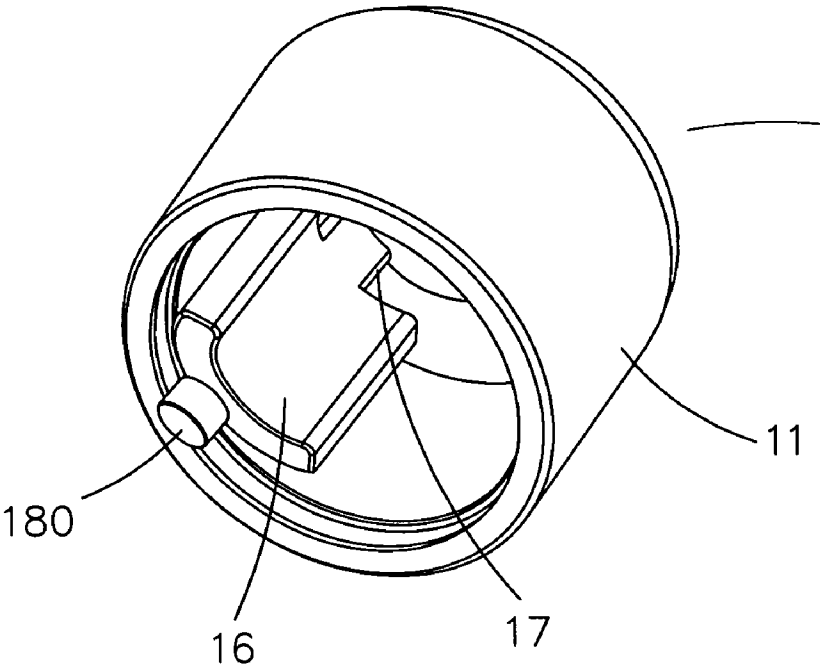
FIG.8 PRIOR ART
FIG. 8 is a locally enlarged perspective assembly view of the conventional pneumatic wrench as shown in FIG. 7.
Figure 11:
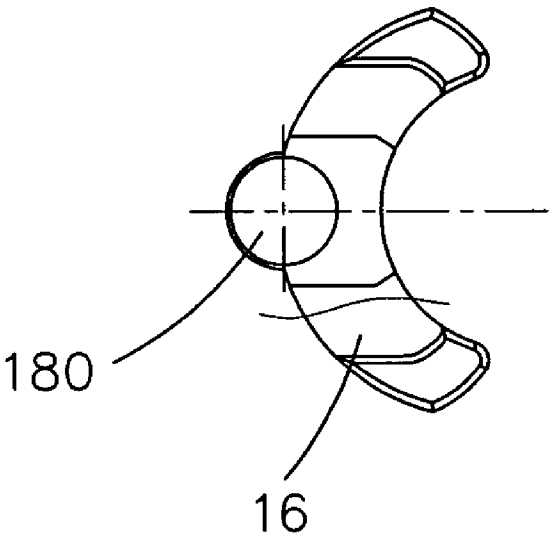
FIG. 11 PRIOR ART
FIG. 11 is a plan view of the hammer of the conventional pneumatic wrench as shown in FIG. 10.
Figure 10:
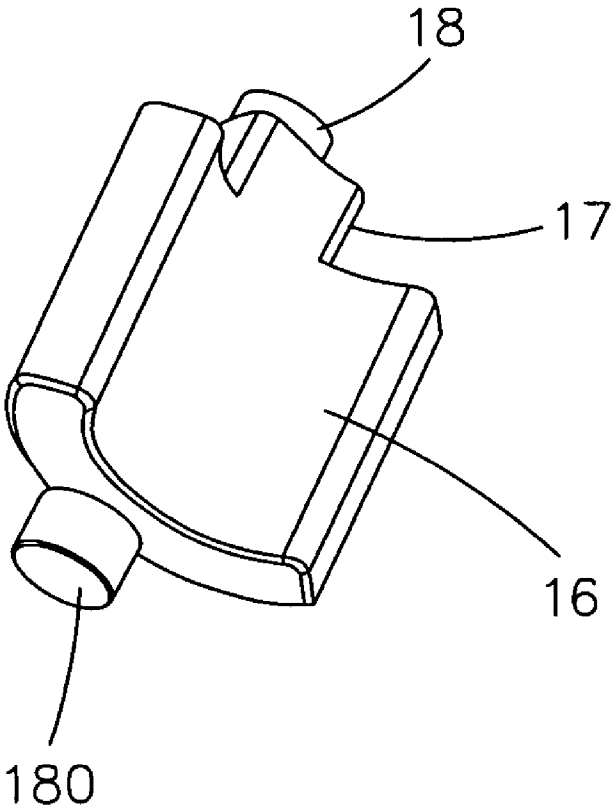
FIG. 10 PRIOR ART
FIG. 10 is a locally enlarged perspective view of a hammer of the conventional pneumatic wrench as shown in FIG. 8.

Referring to the drawings and initially to FIGS. 1 and 2, a pneumatic wrench in accordance with the preferred embodiment of the present invention comprises a pneumatic motor 70, a striking mechanism 50, and a drive shaft 60. The drive shaft 60 is mounted on a socket (not shown), the striking mechanism 50 is mounted on the drive shaft 60, and the pneumatic motor 70 is mounted on the striking mechanism 50 so that the striking mechanism 50 is mounted between the pneumatic motor 70 and the drive shaft 60. Thus, the striking mechanism 50 is driven by the pneumatic motor 70 to rotate in the normal direction and the reverse direction to drive the drive shaft 60 to rotate, so that the drive shaft 60 is driven to rotate the socket mounted on the drive shaft 60 so as to drive and rotate a screw member, such as a bolt, nut or the like.

The striking mechanism 50 includes a cylindrical support seat 51 having a closed first end face and an open second end face, a cam 53 rotatably mounted on the first end face of the support seat 51 and engaged with and rotated by the pneumatic motor 70, a cover 52 mounted on the second end face of the support seat 51, and a substantially arc-shaped hammer 55 rotatably mounted in the support seat 51 and engaged with the cam 53 so that the hammer 55 is driven by the cam 53 to rotate in the support seat 51.

Referring to FIGS. 1–6, the cam 53 has a periphery formed with an engaging recess 54. The hammer 55 has a first end formed with a protruding engaging portion 56 engaged in and driven by the engaging recess 54 of the cam 53 so that the hammer 55 is driven by the cam 53 to rotate in the support seat 51. The first end of the hammer 55 is formed with a reinforcing rib 58 juxtaposed to the engaging portion 56 to reinforce the structural strength of the engaging portion 56 of the hammer 55. The reinforcing rib 58 has a substantially semi-circular shape and is extended to two opposite sides 550 of the hammer 55 so that the two opposite sides 550 of the hammer 55 form a connection by the reinforcing rib 58.

The first end of the hammer 55 is formed with a first pivot shaft 57 pivotally mounted in the first end face of the support seat 51. The hammer 55 has a second end formed with a second pivot shaft 570 pivotally mounted in the second end face of the support seat 51. The second end face of the support seat 51 has a periphery formed with a pivot hole 510 for mounting the second pivot shaft 570 of the hammer 55. The cover 52 has a periphery formed with a substantially arc-shaped protruding rib 520 encompassing the pivot hole 510 of the support seat 51 to withstand the stress of the pivot hole 510 of the support seat 51 so as to enhance the structural strength of the support seat 51.

The drive shaft 60 has a first end formed with an engaging portion 65 engaged with the hammer 55 and a second end formed with a mounting section 62 for mounting the socket. The engaging portion 65 of the drive shaft 60 is formed with a driven groove 66 engaged with and driven by the hammer 55 so as to produce a striking effect on the drive shaft 60 by rotation of the hammer 55.

In operation, after the compressed air enters the pneumatic motor 70, the pneumatic motor 70 is operated to rotate the cam 53 which engages the hammer 55 so that the hammer 55 is driven by the cam 53 to pivot in the support seat 51. Thus, the hammer 55 is pivoted to strike the drive shaft 60, and the hammer 55 strikes the drive shaft 60 once when the hammer 55 is rotated through a circle, so that the drive shaft 60 is driven to rotate the socket mounted on the mounting portion 62 of the drive shaft 60 so as to drive and rotate a screw member, such as a bolt, nut or the like.

Accordingly, the two opposite sides 550 of the hammer 55 are connected by the reinforcing rib 58 to reinforce the structural strength of the hammer 55, thereby preventing the hammer 55 from being distorted or broken due to concentration of a stress so as to enhance the lifetime of the hammer 55. In addition, the cover 52 has a periphery formed with a protruding rib 520 encompassing the pivot hole 510 of the support seat 51 to withstand the stress of the pivot hole 510 of the support seat 51 so as to enhance the structural strength of the support seat 51.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pneumatic wrench, comprising:

a striking mechanism including a cylindrical support seat having a closed first end face and an open second end face, a cam rotatably mounted on the first end face of the support seat, a cover mounted on the second end face of the support seat, and a hammer rotatably mounted in the support seat and engaged with the cam so that the hammer is driven by the cam to rotate in the support seat, wherein the hammer has a first end formed with a protruding engaging portion and a reinforcing rib juxtaposed to the engaging portion to reinforce a structural strength of the hammer.

2. The pneumatic wrench in accordance with claim 1, wherein the reinforcing rib is extended to two opposite sides of the hammer so that the two opposite sides of the hammer form a connection by the reinforcing rib.

3. The pneumatic wrench in accordance with claim 2, wherein the two opposite sides of the hammer are connected by the reinforcing rib to reinforce the structural strength of the hammer.

4. The pneumatic wrench in accordance with claim 1, wherein the reinforcing rib has a substantially semi-circular shape.

5. The pneumatic wrench in accordance with claim 1, wherein the cam has a periphery formed with an engaging recess, and the engaging portion of the hammer is engaged in and driven by the engaging recess of the cam so that the hammer is driven by the cam to rotate in the support seat.

6. The pneumatic wrench in accordance with claim 1, wherein the first end of the hammer is formed with a first pivot shaft pivotally mounted in the first end face of the support seat.

7. The pneumatic wrench in accordance with claim 6, wherein the hammer has a second end formed with a second pivot shaft pivotally mounted in the second end face of the support seat.

8. The pneumatic wrench in accordance with claim 7, wherein the second end face of the support seat has a periphery formed with a pivot hole for mounting the second pivot shaft of the hammer.

9. The pneumatic wrench in accordance with claim 8, wherein the cover has a periphery formed with a protruding rib encompassing the pivot hole of the support seat to withstand the stress of the pivot hole of the support seat so as to enhance the structural strength of the support seat.

10. The pneumatic wrench in accordance with claim 9, wherein the protruding rib of the cover is substantially arc-shaped.

* * * * *